US007129907B2

(12) United States Patent
Lin et al.

(10) Patent No.: US 7,129,907 B2
(45) Date of Patent: Oct. 31, 2006

(54) BROADBAND TUNABLE ANTENNA AND TRANSCEIVER SYSTEMS

(75) Inventors: Zhen Biao Lin, West Hills, CA (US); Jian Quan Lin, Northridge, CA (US); Seymour Robin, Woodland Hills, CA (US)

(73) Assignee: Sensor Systems, Inc., Chatsworth, CA (US)

( * ) Notice: Subject to any disclaimer, the term of this patent is extended or adjusted under 35 U.S.C. 154(b) by 0 days.

(21) Appl. No.: 10/932,238

(22) Filed: Aug. 31, 2004

(65) Prior Publication Data

US 2005/0088362 A1 Apr. 28, 2005

Related U.S. Application Data

(60) Provisional application No. 60/508,419, filed on Oct. 3, 2003.

(51) Int. Cl.
*H01Q 3/24* (2006.01)

(52) U.S. Cl. ..... 343/876; 343/745; 343/750; 343/895

(58) Field of Classification Search ..... 343/700 MS, 343/876, 722, 749, 751, 853, 810, 745, 750, 343/895, 708, 752, 852, 829; 370/478; 342/373
See application file for complete search history.

(56) References Cited

U.S. PATENT DOCUMENTS

| | | | | |
|---|---|---|---|---|
| 4,343,001 A | | 8/1982 | Anderson et al. | 343/745 |
| 4,509,053 A | | 4/1985 | Robin | 343/708 |
| 4,924,238 A | | 5/1990 | Ploussios | 343/802 |
| 4,939,525 A | * | 7/1990 | Brunner | 343/745 |
| 5,231,273 A | * | 7/1993 | Caswell et al. | 235/385 |
| 5,489,912 A | | 2/1996 | Holloway | 343/749 |
| 5,767,812 A | * | 6/1998 | Basciano et al. | 343/722 |
| 5,825,332 A | | 10/1998 | Camacho et al. | 343/708 |
| 6,061,025 A | | 5/2000 | Jackson et al. | 343/700 |

(Continued)

FOREIGN PATENT DOCUMENTS

GB 2100932 6/1985

OTHER PUBLICATIONS

Walden, Marcus, "On Using the Classical Monopole—Antennas of Equal Height", Plextek, Ltd., London Road, Great Chesterford, Essex, United Kingdom, no date available.

(Continued)

*Primary Examiner*—Hoang V. Nguyen
*Assistant Examiner*—Chuc Tran
(74) *Attorney, Agent, or Firm*—Koppel, Patrick & Heybl

(57) ABSTRACT

The present invention is directed to multi-element antennas that include, for each adjacent pair of antenna elements, at least one switch arranged to selectively connect that pair to thereby selectively alter an antenna dimension. Accordingly, a multi-element antenna can be configured to enhance its gain at different operational frequencies while a corresponding impedance matching network can enhance the impedance match (i.e., reduce reflected signal energy) between the antenna and a corresponding system (e.g., a transceiver system). The antenna and system can thus be effectively tuned across a wide operational band. The antenna and impedance matching network are configured with switch command signals and match command signals that are provided in response to each of a plurality of frequency codes.

9 Claims, 7 Drawing Sheets

U.S. PATENT DOCUMENTS

| | | | | |
|---|---|---|---|---|
| 6,208,304 | B1 | 3/2001 | Strickland | 343/705 |
| 6,362,789 | B1 | 3/2002 | Trumbull et al. | 343/700 |
| 6,486,795 | B1 | 11/2002 | Sobel et al. | 340/825 |
| 6,765,443 | B1 * | 7/2004 | Pehike | 330/296 |
| 6,768,456 | B1 * | 7/2004 | Lalezari et al. | 342/373 |
| 6,845,126 | B1 * | 1/2005 | Dent et al. | 375/219 |
| 2002/0175870 | A1 * | 11/2002 | Gleener | 343/745 |
| 2003/0219035 | A1 * | 11/2003 | Schmidt | 370/478 |

OTHER PUBLICATIONS

Schulwitz, Lora, "Minimization of Antenna Size for VHF Frequencies", Dept of Electrical Engineering, University of Michigan, no date available.

* cited by examiner

BROADBAND TUNABLE ANTENNA AND TRANSCEIVER SYSTEMS

CROSS REFERENCES TO RELATED APPLICATIONS

This application claims the benefit of U.S. Provisional Application Ser. No. 60/508,419 filed Oct. 3, 2003.

BACKGROUND OF THE INVENTION

1. Field of the invention

The present invention relates generally to antenna and transceiver systems and, more particularly, to systems that are directed to aircraft installations.

2. Description of the Related Art

There exists a substantial demand for antenna and transceiver systems that can rapidly hop between channels that are distributed over wide frequency bands for the purpose of communicating a variety of communication signals (e.g., voice, data, imagery and video). Although some conventional transceiver systems have operated across restricted frequency ranges, they do not generally satisfy the need for systems that have an extended range (e.g., from 30 MHz to upper limits in the 1 to 2 GHz range). Such extended frequency ranges have been difficult to achieve with a single system, especially when the antenna form factor must also satisfy the aerodynamic and radiative restraints of high speed aircraft.

BRIEF SUMMARY OF THE INVENTION

The present invention is directed to multi-element antennas and to transceiver systems that include these antennas. The novel features of the invention are set forth with particularity in the appended claims. The invention will be best understood from the following description when read in conjunction with the accompanying drawings.

DETAILED DESCRIPTION OF THE INVENTION

FIGS. 1–4 illustrate multi-element antennas and transceiver systems that include the antennas. The antennas provide a significantly-enhanced degree of freedom (i.e., number of options) for improving the operational parameters of the systems as they are tuned across a wide operational band. The features and advantages of these antennas and systems will become apparent in the following description.

Figures 1, 2A, 2B:
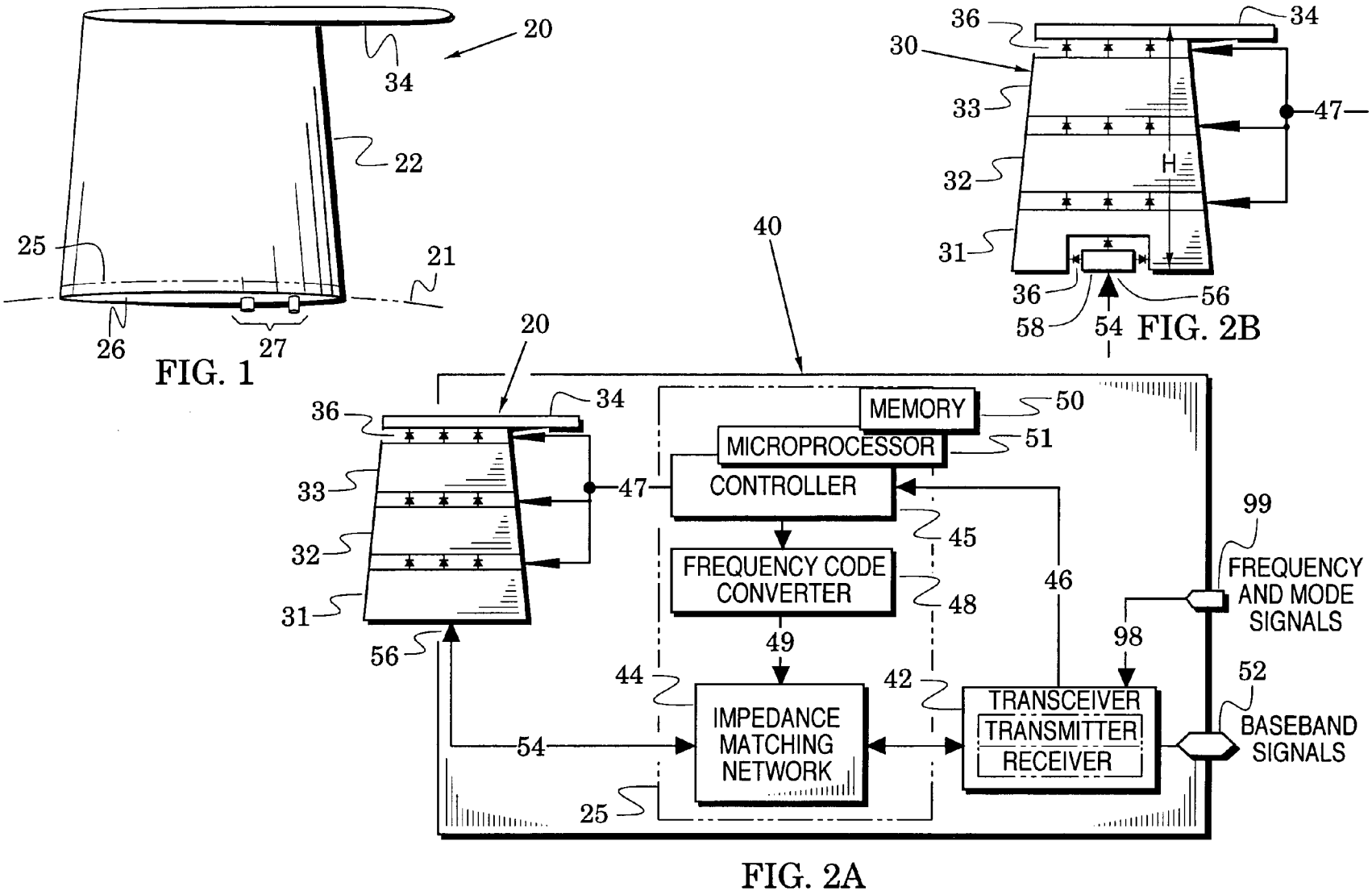
FIG. 1 is a perspective view of a multi-element antenna embodiment of the present invention.
FIG. 2A is a block diagram of a transceiver system embodiment that includes details of the antenna of FIG. 1.
FIG. 2B is a side view of another embodiment of the antenna of FIG. 2A.

In particular, a multi-element antenna embodiment 20 of the present invention is shown in FIG. 1 and FIG. 2A is a block diagram of a transceiver system embodiment 40 of the invention that mates the antenna to a transceiver 42. The transceiver system 40 includes an impedance matching network 44 coupled between the antenna 20 and the transceiver 42 and a controller 45 which receives frequency and mode commands 46 from the transceiver.

The controller 45 converts these commands to switch command signals 47 for the antenna 20 and to frequency codes for a frequency code converter 48 which converts the codes to match command signals 49 that are provided to the impedance matching network 44. To aid in generation of the switch command signals and match command signals, embodiments of the controller and frequency code converter may include a memory 50 for storing conversion data and a microprocessor 51 for directing conversion processes. The microprocessor may be programmed with software that defines antenna configurations in response to the frequency and mode commands 46.

Bidirectional microwave system signals 54 are exchanged with the antenna 20 through its signal port 56. As shown, the transceiver 42 includes a transmitter that provides upstream microwave system signals 54 to the antenna in response to baseband signals received at a system port 52 and a receiver that provides baseband signals in response to downstream microwave system signals 54 from the antenna.

Although the concepts of the multi-element antenna 20 can be directed to a variety of applications, it is particularly suited for use as a monopole antenna that extends from the outer skin 21 of an aircraft as indicated in FIG. 1. To reduce its drag in an aircraft application, the antenna's outer cover 22 has an aerodynamic shape and terminates at its upper end in an aerodynamically-shaped top load 34 which provides a capacitive load to the antenna 20. The lower end of the cover 22 fits over a base 25 which can carry some of the system elements of FIG. 2A (e.g., the impedance matching network 44, the controller 46 and the frequency code converter 48) and has a lower surface 26 that mounts at least one electrical connector 27 (used, for example, to form the port 56 and for connection to other system elements).

In a benign environment, the gain and efficiency of a monopole antenna is enhanced if it has an electrical length $\lambda/4$ (wherein $\lambda$ is the signal wavelength), extends away from an infinite ground plane and presents an impedance that matches the impedance of its mating system elements to thereby enhance system efficiency by reducing reflected energy. It is difficult to approach these ideal parameters in an aircraft environment where the antenna's physical length must be limited because of aerodynamic considerations (e.g., $\lambda/4$ is on the order of 2.5 meters for an exemplary system operating frequency of 30 MHz). In addition, an aircraft's skin provides a limited ground plane and many communication systems operate over a wide bandwidth in which the impedances of fixed elements will vary substantially.

Embodiments of the present invention recognize, however, that antenna parameters can be significantly enhanced with an antenna that can be reconfigured for operation in different portions of a wide system bandwidth. Accordingly, the antenna 20 of FIG. 1 includes at least two antenna elements. FIG. 2A, for example, shows an antenna embodiment that has elements 31, 32, 33 and an upper element which is the top load 34. For each adjacent pair of the antenna elements, at least one switch 36 is arranged to selectively connect that pair in response to the match command signals 47 to thereby selectively alter an antenna dimension. In FIG. 2A, the altered antenna dimension extends away from the antenna signal port 56, i.e., the altered antenna dimension is its height that extends away from the aircraft skin 21 in FIG. 1.

Figure 3:
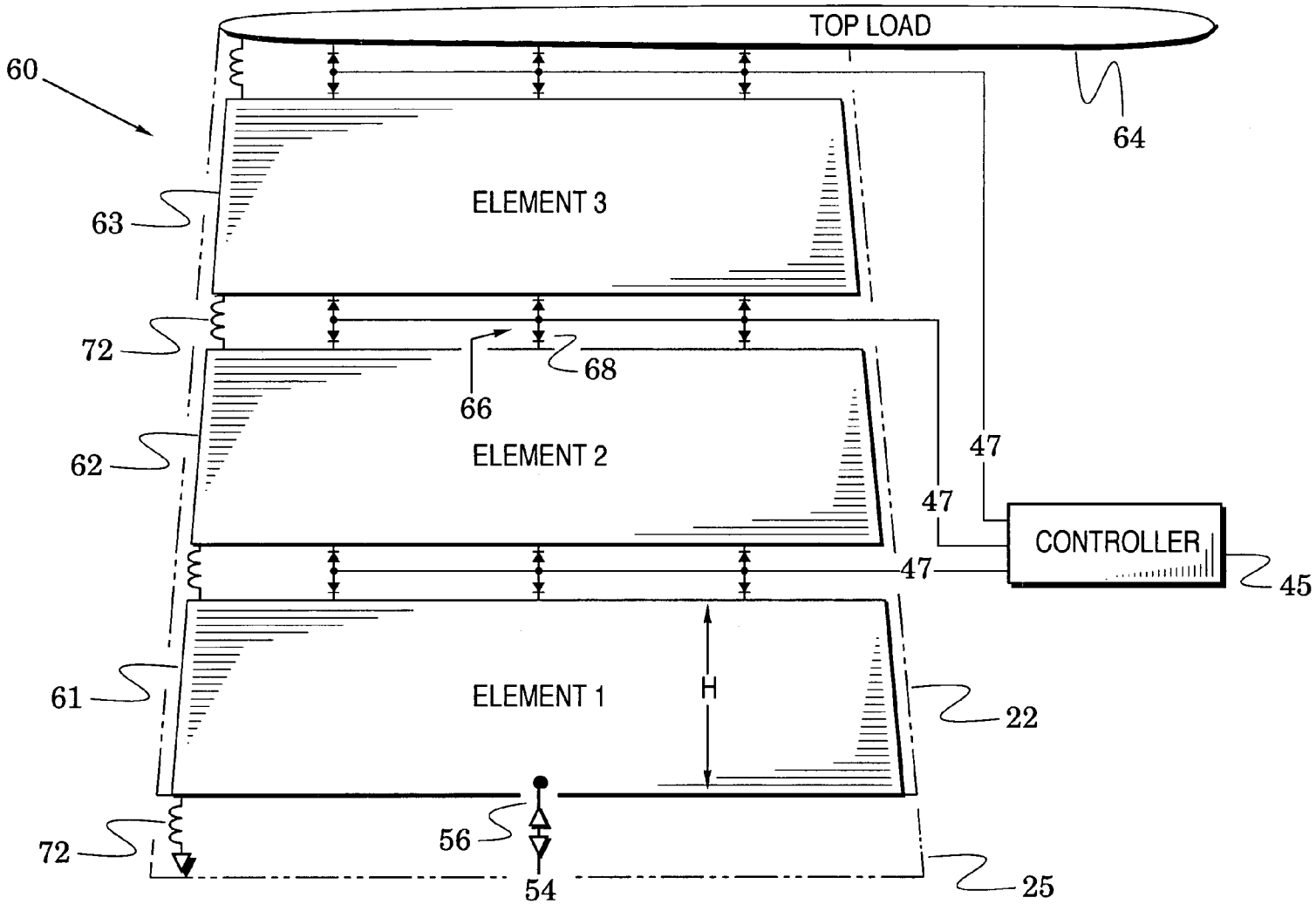
FIGS. 3 and 4 are side views of other multi-element antenna embodiments for the transceiver system of FIG. 2.
Figure 4:
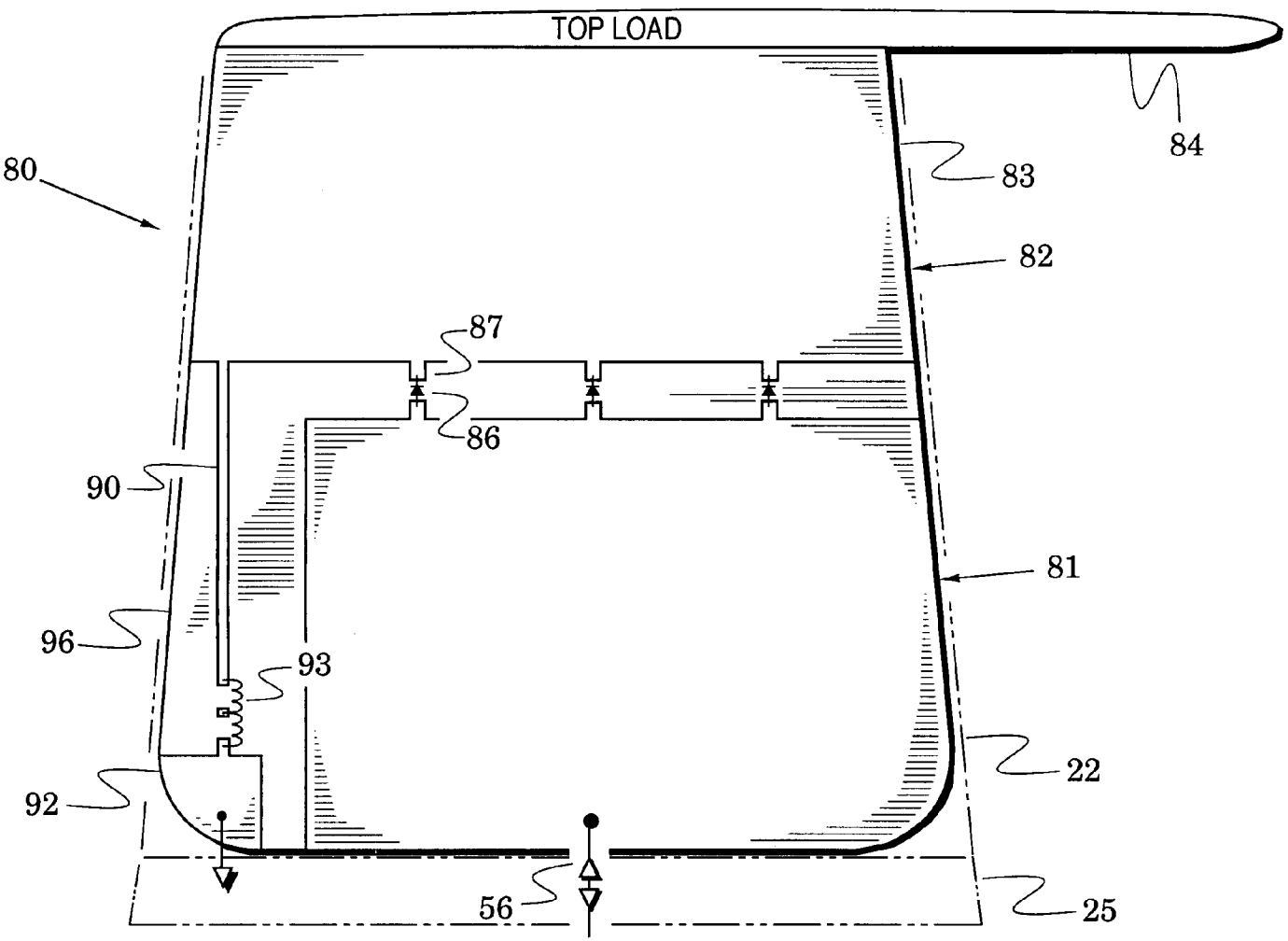

To enhance a subsequent description of the operation of the transceiver system 40 of FIG. 2A, it is helpful to initially direct attention to FIGS. 2B, 3 and 4 which respectively illustrate other multi-element antenna embodiments 30, 60 and 80 which, in general, comprise N antenna elements. In particular, the antenna 30 of FIG. 2A is similar to the antenna 20 of FIG. 2A with like elements indicated by like reference numbers. In contrast to the antenna 20, however, the antenna 30 removes a portion from the base of antenna element 31 and inserts another smaller antenna element 58 which exchanges the microwave signals 54 at the signal port 56.

At least one switch 36 is arranged to selectively connect the antenna elements 58 and 31 in response to the match command signals 47 to thereby selectively alter an antenna dimension. In the antenna 30, N=5 and the altered antenna dimensions extend vertically and horizontally from the antenna signal port 56.

The antenna 30 is formed by all of its elements at its lowest operating frequencies and by the element 58 at is highest operating frequencies. The top load provides a capacitive load that helps to electrically lengthen the antenna at the lowest operating frequencies and the added antenna element 58 is useful for raising the upper end of the frequency bandwidth of the antenna 30 above the corresponding upper end of the antenna 20.

In the antenna 60 of FIG. 3, N=4 and, accordingly, this figure illustrates four antenna elements which are shown as planar elements 61, 62 and 63 (noted as elements 1, 2 and 3) and another element which is a top load 64. For each adjacent pair of these antenna elements, three switches 66 are provided to selectively connect that pair and alter the antenna height (the antenna dimension extending away from the antenna's signal port 56.

Each of the switches 66 is formed, in this embodiment, with a pair of diodes 68 arranged with their anodes coupled to receive switch command signals 47 from the controller 45 and their cathodes coupled to their respective antenna elements. Each adjacent pair of antenna elements is also coupled together by an inductor 72 with another inductor coupling the first antenna element 61 to signal ground. The inductors 72 are configured to provide a low-frequency (i.e., DC) path between antenna elements but a blocking impedance to the system signals 54 that pass through the signal port 56.

Accordingly, a respective switch command signal 47 of the controller 45 can drive current through a respective set of the diodes 68 (and through the associated inductors 72) to selectively couple a selected pair of the antenna elements. Alternatively, the switch command signal 47 can take the form of a reverse bias voltage when it is desired to electrically separate that pair of antenna elements. The drive current and the reverse bias are both configured by the controller 46 to be sufficient to selectively couple and decouple the antenna elements during peak amplitudes of the system signals passing through the signal port 56.

The diodes are preferably realized with diodes (e.g., PIN diodes) that are physically small, have low parasitic capacitance and are capable of high switching speeds. Several switches 66 are preferably provided between each adjacent pair of antenna elements so that they can be closely spaced to minimize impedance between all portions of coupled antenna elements.

Bidirectional microwave system signals 54 (indicated by arrowheads) are exchanged with the antenna 60 at its signal port 56 which is coupled to a first one (61) of the antenna elements and is associated with the base 25 (introduced in FIG. 1). When used as an aircraft antenna, the top load 64 is aerodynamically shaped and the antenna is enclosed in the aerodynamic cover 22 introduced in FIG. 1. The switch command signals 47 can selectively cause the antenna to be formed by all elements at the lowest operating frequency and then successively remove elements so that, at the highest operating frequency, the antenna is formed by only the element 61. The top load provides a capacitive load that helps to electrically lengthen the antenna at the lowest operating frequencies.

In the antenna 80 of FIG. 4, N=2 and, accordingly, this illustrates two antenna elements which are shown as a planar element 81 and an element 82 which has a planar portion 83 and an attached aerodynamic top load portion 84. For the adjacent pair of antenna elements, three switches 86 are provided to selectively connect them to thereby selectively alter the antenna height (the antenna dimension extending away from the antenna's signal port 56.

Each of the switches 86 is preferably realized with a high-speed diode that is coupled to legs 87 which extend from the antenna elements. An extension 90 extends downward from the planar portion 83 and is coupled to a ground patch 92 through an inductor 93. The extension 90 and the inductor 93 are configured to provide a low-frequency (i.e., DC) path to ground but a blocking impedance to the system signals that pass through the signal port 56.

In contrast to the antenna 60 of FIG. 3, the antenna 80 receives its switch command signals 47 through the system signal port 56 to thereby couple or decouple the antenna elements 81 and 82 via the high-speed diodes 86. In the antenna 80, the antenna element 81, the element portion 83, the legs 87, the extension 90 and the ground patch 92 can be conveniently realized with low-impedance sheets (e.g., copper sheets) that are carried over a planar dielectric 96.

In aircraft applications, the antenna elements of the antennas 20, 30, 60 and 80 of FIGS. 2A, 2B, 3 and 4 are preferably planar in shape and arranged substantially coplanar. The element height (indicated by H in element 61 of FIG. 3) is generally substantially less than $\lambda/4$ for all frequencies in that element's bandwidth. Although this reduces antenna gain, it enhances the use of the antenna embodiment in aircraft applications. The width of each element is generally chosen to enhance element bandwidths. The antennas can be configured to operate in a variety of signal bands (e.g., VHF, TVHF, UHF and L bands) with total antenna heights (indicated by H in FIG. 1) in a range generally on the order of 9–12 inches.

Having described the antenna embodiments 20, 30, 60 and 80 of FIGS. 2A, 2B, 3 and 4, attention is now returned to the transceiver system 40 of FIG. 2A. The system 40 couples the impedance matching network 44 between the antenna 20 and the transceiver 42 and arranges the controller 45 and frequency code converter 48 to provide switch command signals 47 and match command signals 49 in response to frequency and mode commands 46. In addition to coupling its baseband signals through the port 52, the transceiver provides the commands 46 in response to system frequency and mode commands 98 which it receives via a system port 99.

The controller 45 and frequency code converter 48 can command various combinations of physical and electrical antenna lengths, capacitive top loads and reactive matching networks to thereby enhance system parameters such as gain, efficiency and voltage standing wave ratio (VSWR). Various combinations of the switch command signals 47 and match command signals 49 can be formed for each system operating frequency and stored in the controller's memory 50.

In an exemplary operation of the transceiver system 40, the transceiver is commanded by the system commands 98 to shift from a current operational frequency to a subsequent operational frequency. In response, it adjusts appropriate elements of its transmitter and receiver (e.g., oscillator and filter frequencies) and provides a corresponding command 46 to the controller 45. The controller, in turn, provides a switch command signal 47 and (via its associated frequency code converter) a match command signal 49 which realize predetermined configurations of the multi-element antenna 20 and the impedance matching network 44 that are appropriate the subsequent operational frequency.

In another exemplary operation of the transceiver system 40, the transceiver may receive a mode command which calls out a series of operational frequencies that are to be realized in a predetermined sequence over a subsequent time interval. In response, the transceiver appropriately adjusts elements of its transmitter and receiver over the time interval and the controller and frequency code converter provide switch command signals 47 and match command signals 49 which change over the subsequent time interval to configure the antenna 20 and the impedance matching network to correspond to the sequence of operational frequencies.

The microprocessor 51 and memory 50 of FIG. 2A are particularly suited for forming a portion or all of the controller 45 and its associated frequency code converter 48 when mode commands are applied to the system 40. For example, the memory may store conversion data associated with a sequence of commands 46 and the microprocessor 51 may execute a sequence of conversion processes in response to the stored data.

In this operation, the microprocessor is preferably programmed to respond to software so that it can be quickly and easily altered to appropriately alter the sequence of antenna and impedance matching network configurations to correspond to new or revised system modes that may be applied to the system via the system port 99. The system 20 thus provides a software-definable and tunable response over a broad band of operating frequencies.

Figure 5B:
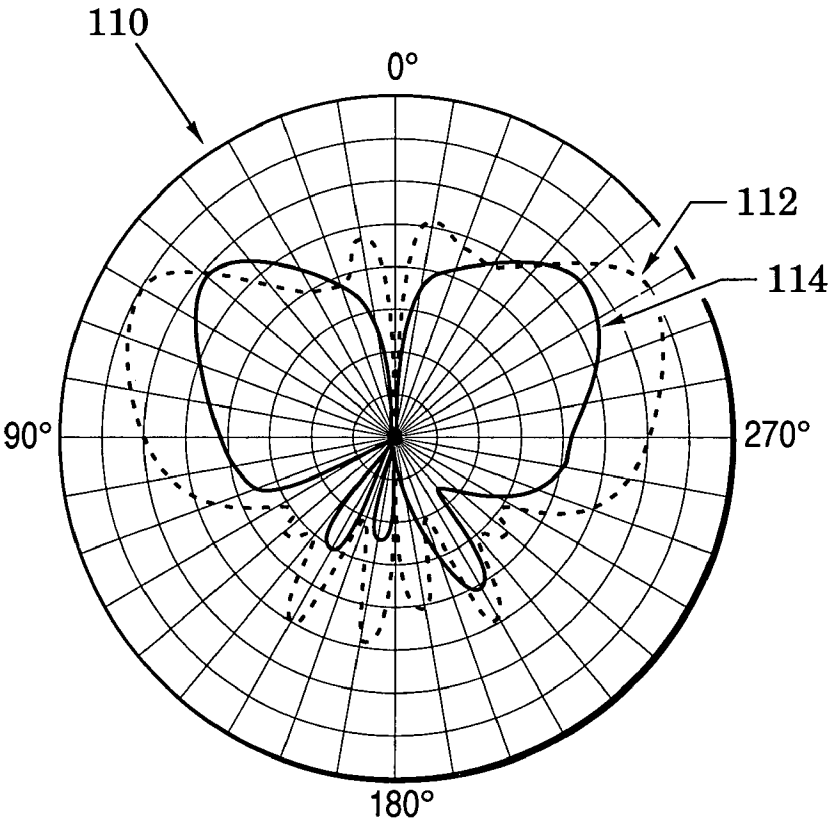
FIGS. 5A and 5B are graphs which show measured gains for a multi-element antenna embodiment that is configured by a controller of the system of FIG. 2.
Figure 5A:
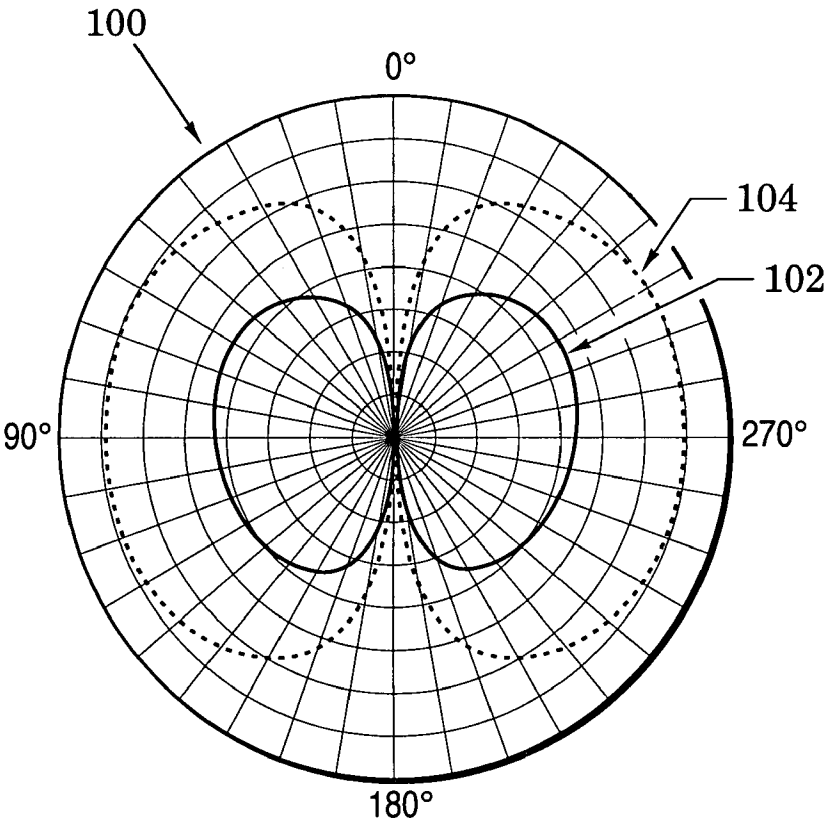
Figure 6B:
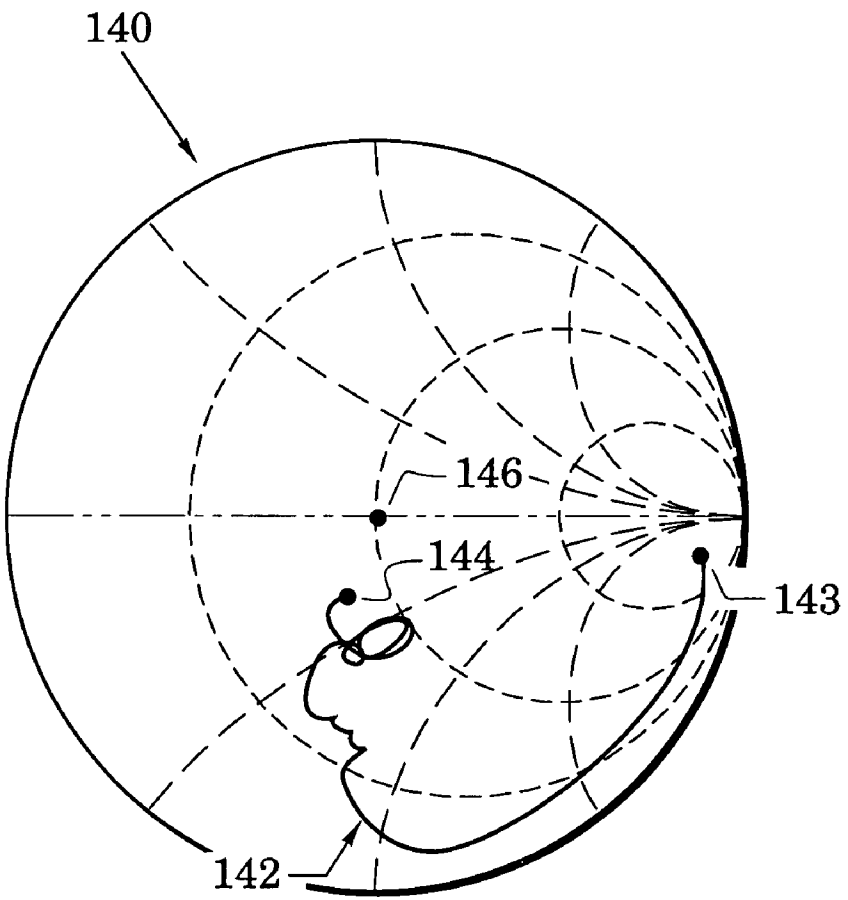
FIGS. 6A and 6B are Smith charts which show measured impedances for a multi-element antenna embodiment that is configured by a controller of the system of FIG. 2.
Figure 6A:
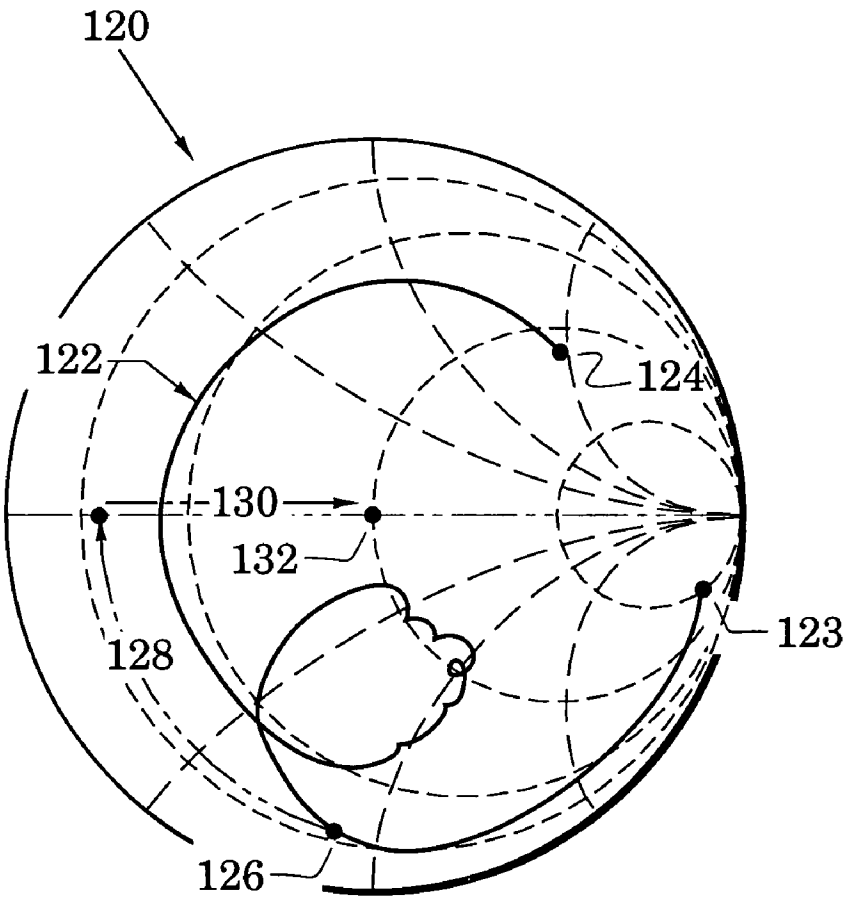
Figure 7:
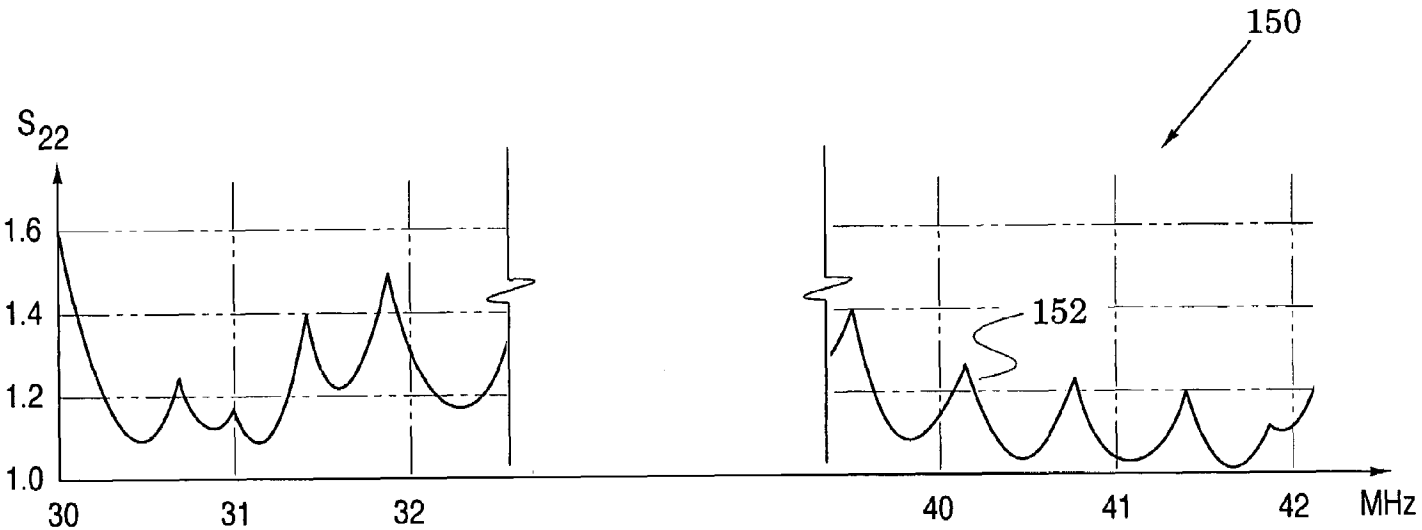
FIG. 7 is a graph which illustrates reflected energy from an impedance matching network that is configured by a controller of the system of FIG. 2.

The antenna gain patterns of FIGS. 5A and 5B, the plotted impedances of the Smith charts of FIGS. 6A and 6B and the reflected energy plots of FIG. 7 show examples of measured system parameters in antenna embodiments of the invention over various operational frequencies. FIG. 5A illustrates, for example, the measured gain 102 at 70 MHz of a exemplary antenna similar to the antenna 80 of FIG. 4 with its antenna elements 81 and 82 selectively coupled together. The measurement was made with an 8 foot circular ground plane and is compared with the measured gain 104 of a $\lambda/4$ monopole.

In response to higher commanded frequencies, these antenna elements can be decoupled so that the system operates only with the antenna element 81. The measured gain 112 of this exemplary antenna is shown in the gain graph 110 of FIG. 5B and is compared there to the gain 114 of a $\lambda/4$ monopole. Although the gains of FIGS. 5A and 5B are less than that of a $\lambda/4$ monopole, they represent significantly greater gains that could be obtained with a conventional fixed blade antenna.

Similar to FIG. 5A, the Smith chart 120 of FIG. 6A also corresponds to an exemplary antenna that includes the antenna elements 81 and 82 of FIG. 4. Plot 122 extends from 30 MHz at an initial end 123 to 400 MHz at a terminal end 124. The initial end 123 is substantially spaced from the high impedance end of the Smith chart by the capacitance provided by the top load (64 in FIG. 3).

Assuming point 126 is the antenna impedance at 100 MHz, the match command signals 49 of FIG. 2A can selectively couple an inductor of the impedance matching network 44 in series with the antenna's signal port 56 to transform the impedance along the impedance path 128 in FIG. 6A to a real impedance on the horizontal axis of the Smith chart 120. The match command signals 49 of FIG. 2A can further selectively couple a transformer of the impedance matching network 44 to transform this real impedance along the impedance path 130 up to the impedance (e. g., 50 ohms) at the center 132 of the Smith chart 120 that represents the impedance of the transceiver (42 in FIG. 2A).

The Smith chart 140 of FIG. 6B corresponds to an exemplary antenna that is formed with only the antenna element 81 of FIG. 4 (as in FIG. 5B). For this significantly shorter antenna, the plot 142 extends from 30 MHz at an initial end 143 to 400 MHz at a terminal end 144. Again, the match command signals 49 of FIG. 2A can selectively couple elements of the impedance matching network 44 in series with the antenna's signal port 56 to transform an impedance along the plot 142 to the center 146 of the Smith chart.

As the operational frequency of the transceiver system 40 of FIG. 2A increases, for example, the match command signals 49 can repeatably reconfigure the impedance matching network 44 to maintain a suitable match between the antenna 20 and the transceiver 42. The graph 150 of FIG. 7, for example, shows a plot 152 of the S parameter $S_{22}$ (a measure of reflected energy) at the output of the impedance matching network 44 of FIG. 2A as serially-connected inductors are successively selected to maintain $S_{22}$ below a desired level (e.g., 1.6) as the system frequency increases over an exemplary range of 30–42 MHz (center portion not shown).

Figure 8:
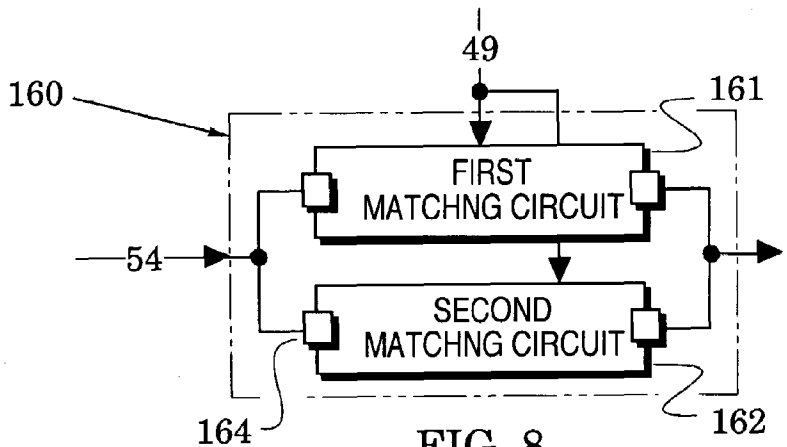
FIG. 8 is a block diagram of an impedance matching network embodiment in the transceiver system of FIG. 2.

The impedance matching network 44 of FIG. 2A can be realized with a variety of arrangements of reactive elements. FIG. 8, for example shows an exemplary embodiment in which a network 160 is formed with first and second sets 161 and 162 of matching circuits. Switches 164 are provided so that the switch command signals 49 of FIG. 2A can command the network 160 into selected arrangements of the matching circuits 161 and 162, e.g., a selected one of the circuits, a parallel combination of both circuits, or a first circuit in series with the second circuit coupled in shunt to a selected end of the first.

Figure 9:
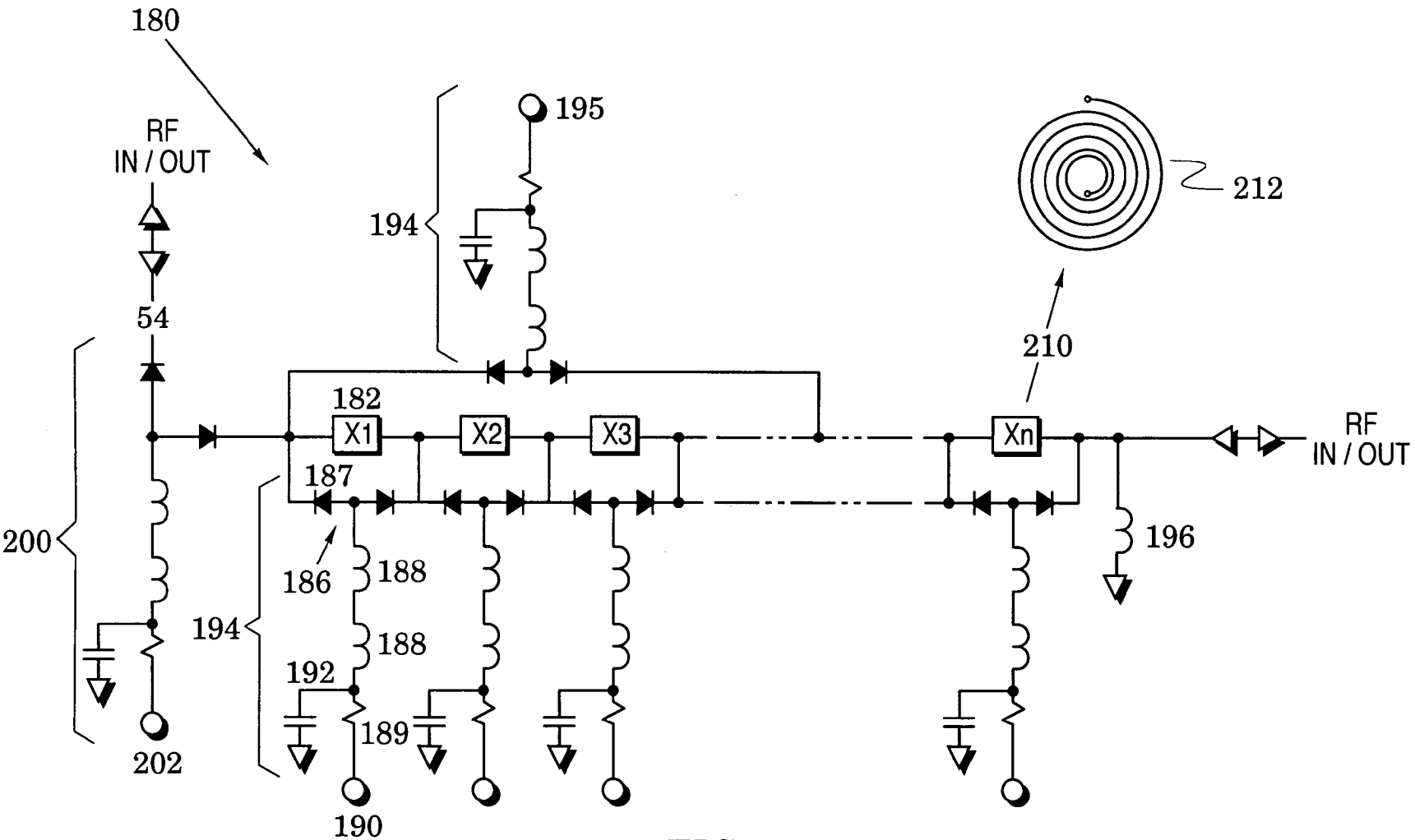
FIG. 9 is a circuit diagram of a matching circuit embodiment in the network of FIG. 8.

Although the first and second matching circuits 161 and 162 of FIG. 8 can be formed with various combinations of reactive elements (capacitors, inductors and transformers, FIG. 9 illustrates an exemplary circuit 180 that comprises a plurality of serially-coupled signal inductors 182 (labeled X1, X2, . . . Xn) that receive the microwave system signals 54.

A pair 186 of PIN diodes 107 are coupled about each of the inductors 102 with, for example, their anodes coupled together. At least one inductor 188 (two shown as an example) and a resistor 189 are serially-coupled between the coupled PIN diodes and a bias port 190 which is shunted by a capacitor 192.

Each pair 186 of PIN diodes, inductors 188, resistor 189, capacitor 192 and bias port 190 forms a bias-applying circuit 194 which is provided to each of the signal inductors 182. The inductors 188 and resistor 189 and shunt capacitor 192 are configured to present a high impedance to avoid disturbance of signals passing through the signal inductors 182. A plurality of inductors 188 may be used so that each can be directed to presentation of a high impedance to a corresponding portion of the overall signal band. Preferably, at least one additional bias-applying circuit 194 (with a bias port 195) is coupled about a plurality of the signal inductors 182. Finally, an inductor 196 couples the signal inductors 182 to signal ground.

As an example, one of the switches 164 of FIG. 8 is shown as a switch 200 which is a modified version of the bias-applying circuits 194 and it is used to couple the signal inductors 182 to the system signals 54. The circuit 200 is modified in that its PIN diodes are coupled in series with the signal line (rather than being coupled about a signal inductor). The circuit 200 terminates in a bias port 202.

An exemplary arrow 210 indicates that, in one embodiment, the signal inductors 182 are realized as spiral inductors 212 which can be easily formed with a spiral line carried on a substrate. The spiral configuration reduces spurious capacitance.

In operation of the circuit 180, the frequency code converter (48 in FIG. 2A) drives a bias current through any selected one of the bias ports 190. The bias current passes through corresponding PIN diodes and passes through intervening signal inductors 182 and the inductor 196 that is coupled to signal ground. This causes the corresponding PIN diodes to have a low impedance which essentially takes the corresponding signal inductor 182 out of the signal chain. In a different operation of the circuit 180, the frequency code converter places a reverse bias (relative to the signal ground associated with the inductor 196) across any selected one of the bias ports 190. The causes the corresponding PIN diodes to have a high impedance so that the corresponding signal inductor 182 is operationally coupled to process the system signals 54.

In a similar manner, the frequency code converter can drive a bias current through the bias port 195 to remove several associated signal inductors 182 from the signal chain. If it is desired to remove several signal inductors 182 from the signal chain, this may be accomplished by having the controller drive a bias current through the bias port 195. This arrangement may present less spurious impedances (e.g., stray capacitance) than removing the same signal inductors with signals at their respective ports 190.

As described above, the controller and frequency code converter 46 of FIG. 2A can be configured to receive frequency codes 47 from the transceiver 42 and, in response, convert them, with reference to memory 50, to predetermined switch select signals 47 and match command signals 49. The switch select signals 47 configure the multi-element antenna 20 to enhance its gain at different operational frequencies and the match command signals 49 configure the impedance matching network to enhance the impedance match (i.e., reduce reflected signal energy) between the antenna and the transceiver 42. The antenna and its transceiver system can thus be effectively tuned across a wide operational band. The controller and frequency code converter can be realized with arrays of gates, at least one appropriately-programmed computer, or combinations thereof.

FIGS. 1–9 thus show embodiments of software-definable and tunable antenna and transceiver systems which are configured to operate over a broad band of operating frequencies in response to system commands. The embodiments of the invention described herein are exemplary and numerous modifications, variations and rearrangements can be readily envisioned to achieve substantially equivalent results, all of which are intended to be embraced within the spirit and scope of the invention as defined in the appended claims.

We claim:

1. An antenna system for an aircraft, comprising:

an aerodynamically-shaped cover that terminates in first and second ends wherein said first end is configured to join said aircraft; and a monopole antenna extending through said cover wherein said monopole antenna includes;

a) at least first and second antenna elements wherein said first antenna element has a planar shape and is positioned proximate to said first end and said second antenna element is an aerodynamically-shaped top load positioned proximate to said second end; and b) for each adjacent pair of said antenna elements, at least one switch arranged to selectively connect said pair to thereby selectively alter the length of said monopole antenna;

wherein said first antenna element defines a signal port proximate to said first end for exchange of antenna signals with said monopole antenna.

2. The system of claim 1, wherein said switch comprises at least one diode.

3. The system of claim 1, wherein said signal port comprises an electrical connector coupled to said first antenna element.

4. The system of claim 1, wherein at least a third antenna element has a planar shape and is inserted between said first and second antenna elements.

5. The system of claim 1, wherein said antenna further includes a dielectric substrate that carries at least one of said antenna elements.

6. An antenna system for an aircraft, comprising:

an aerodynamically-shaped cover that terminates in first and second ends wherein said first end is configured to join said aircraft; and a monopole antenna extending through said cover wherein said monopole antenna includes;

a) at least first and second antenna elements wherein said first antenna element has a planar shape and is positioned proximate to said first end and said second antenna element has a planar shape and is positioned proximate to said second end; and b) for each adjacent pair of said antenna elements, at least one switch arranged to selectively connect said pair to thereby selectively alter the length of said monopole antenna; and a controller that commands the state of said switch;

wherein said first antenna element defines a signal port proximate to said first end for exchange of antenna signals with said monopole antenna.

7. The system of claim 6, wherein said switch comprises at least one diode.

8. The system of claim 6, wherein a third antenna element is an aerodynamically-shaped top load inserted between said second end and said second antenna element.

9. The system of claim 6, wherein said signal port comprises an electrical connector coupled to said first antenna element.

* * * * *